US009227414B2

(12) United States Patent
Ichihara

(10) Patent No.: US 9,227,414 B2
(45) Date of Patent: Jan. 5, 2016

(54) LIQUID EJECTING APPARATUS

(71) Applicant: SEIKO EPSON CORPORATION, Tokyo (JP)

(72) Inventor: Keita Ichihara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/168,985

(22) Filed: Jan. 30, 2014

(65) Prior Publication Data

US 2014/0225963 A1 Aug. 14, 2014

(30) Foreign Application Priority Data

Feb. 8, 2013 (JP) ..... 2013-022936

(51) Int. Cl.
*B41J 2/175* (2006.01)
*B41J 2/18* (2006.01)

(52) U.S. Cl.
CPC ..... *B41J 2/175* (2013.01)

(58) Field of Classification Search
CPC ..... B41J 2/175; B41J 2/17503; B41J 2/18
USPC ..... 347/7, 84, 85, 86, 89, 92
See application file for complete search history.

(56) References Cited

U.S. PATENT DOCUMENTS

2005/0007399 A1* 1/2005 Harvey et al. ..... 347/6
2009/0102879 A1* 4/2009 Katada et al. ..... 347/17
2013/0010037 A1 1/2013 Yokoyama et al.
2013/0021396 A1* 1/2013 Hirano ..... 347/6

FOREIGN PATENT DOCUMENTS

JP 10-138515 5/1998
JP 2000-015837 1/2000
JP 2004-098365 4/2004
JP 2011-110853 9/2011

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A liquid ejecting apparatus includes: a liquid ejecting head for ejecting liquid; a first flow path through which liquid is supplied from a first container provided at an upstream to the liquid ejecting head provided at a downstream; a second flow path that forms a circulation flow path in which the liquid is capable of circulating through the circulating flow path including the first flow path and the second flow path; and a third flow path through which liquid is supplied from a second container provided at an upstream to the circulation flow path provided at a downstream, and a downstream end of the third flow path is coupled to one of the second flow path and a section on an upstream side of the downstream joint with the second flow path in the first flow path.

7 Claims, 2 Drawing Sheets

LIQUID EJECTING APPARATUS

BACKGROUND

1. Technical Field

The present invention relates to a liquid ejecting apparatus including a circulation flow path through which liquid is circulated.

2. Related Art

Up to now, a printer (liquid ejecting apparatus), which returns a part of ink (liquid) that had been supplied from an ink tank (container) to a recording head (liquid ejecting head) to the ink tank and can supply the recovered ink to the recording head again, is well known (see JP-A-10-138515). That is, in this printer, ink is circulated between the ink tank and the recording head.

Meanwhile, in this printer, a discharge port for discharging ink and a receive port for receiving ink are formed in both of the ink tank and the recording head. Further, the discharge port of the ink tank and the supply port of the recording head are coupled with a tube and the receive port of the ink tank and the discharge port of the recording head are coupled with a tube to form the circulation flow path.

Therefore, when the number of ink tanks is increased, there is a problem that the circulation flow paths are required for respective ink tanks and the structure becomes complicated.

Note that such a problem is not limited to the printer including the circulation flow path and is generally common to the liquid ejecting apparatus including the circulation flow path.

SUMMARY

An advantage of some aspects of the invention is to provide a liquid ejecting apparatus which can increase the number of containers that can supply liquid to a liquid ejecting head via a circulation flow path while suppressing complication of the structure.

Hereinafter, means for solving the problem and the actions and effects will be described.

According to an aspect of the invention, a liquid ejecting apparatus includes: a liquid ejecting head for ejecting liquid; a first flow path through which liquid is supplied from a first container provided at an upstream to the liquid ejecting head provided at a downstream; a second flow path that forms a circulation flow path by coupling an upstream end thereof to an upstream joint of the first flow path and by coupling a downstream end thereof to a downstream joint of the first flow path, the liquid being capable of circulating through the circulation flow path including the second flow path and a section between the upstream joint and the downstream joint in the first flow path; and a third flow path through which liquid is supplied from a second container provided at an upstream to the circulation flow path provided at a downstream, and a downstream end of the third flow path is coupled to one of the second flow path and a section of an upstream side of the downstream joint in the first flow path.

According to this configuration, it is possible to supply liquid which is supplied from the first container and the second container via one circulation flow path to the liquid ejecting head. Therefore, it is possible to increase the number of containers that can supply liquid to the liquid ejecting head via the circulation flow path while suppressing complication of the structure.

In this case, it is preferable that the liquid ejecting apparatus further include: a first supply pump that is provided on the first flow path at a section between the first container and a joint provided on a most upstream side among joints that are coupled to other flow paths and that supplies liquid stored in the first container to a downstream; and a second supply pump that is provided on the third flow path and supplies liquid stored in the second container to a downstream.

According to this configuration, it is possible to select the container which supplies liquid to the liquid ejecting head by selectively operating the first supply pump corresponding the first container and the second supply pump corresponding the second container.

In this case, it is preferable that the liquid ejecting apparatus further include a moving mechanism which moves at least a part of the circulation flow path and the liquid ejecting head.

According to this configuration, when the moving mechanism moves the liquid ejecting head, at least a part of the circulation flow path follows to move. Therefore, liquid is stirred not only during circulation in the circulation flow path but also during movement by the moving mechanism. Therefore, it is possible to effectively stir ink while suppressing increase of the number of components of the liquid ejecting head.

In this case, it is preferable that, in the liquid ejecting apparatus, the circulation flow path be provided to have difference in height in a gravity direction.

When position of the liquid ejecting head and positions of the containers are different in a gravity direction, there causes difference in height in the flow paths for supplying liquid to the liquid ejecting head from the containers. Further, when inclinations of the flow paths are larger in portions with large difference in height than those with small difference in height, a degree of precipitation in a supplied liquid whose ingredients are easy to precipitate becomes large. In this point, it is possible to reduce difference in height in portions other than the circulation flow path by providing difference in height with the circulation flow path. That is, it is possible to supply liquid to the liquid ejecting head while suppressing precipitation of liquid ingredients by providing difference in height with the circulation flow path in which stirring is possible by circulating liquid.

According to another aspect of the invention, the liquid ejecting apparatus includes: a liquid ejecting head which ejects liquid that is supplied from two or more containers storing liquid; two or more container-side flow paths which are provided for the respective containers and through which liquid is supplied from the containers provided at an upstream to a downstream that is an opposite side of the container; a circulation flow path which is provided on a downstream of the container-side flow paths and which is capable of circulating liquid supplied from the containers; and a head-side flow path in which an upstream end thereof is coupled to the circulation flow path and through which liquid is supplied to the liquid ejecting head provided at a downstream, and, in each of the container-side flow paths, a downstream end thereof is coupled to any one of the circulation flow path and the other container-side flow paths and at least one downstream end of the container-side flow paths is coupled to the circulation flow path.

According to this configuration, it is possible to achieve effects similar to those of the above liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet printer which is an example of a liquid ejecting apparatus will be explained with reference to the drawings.

Figure 1:
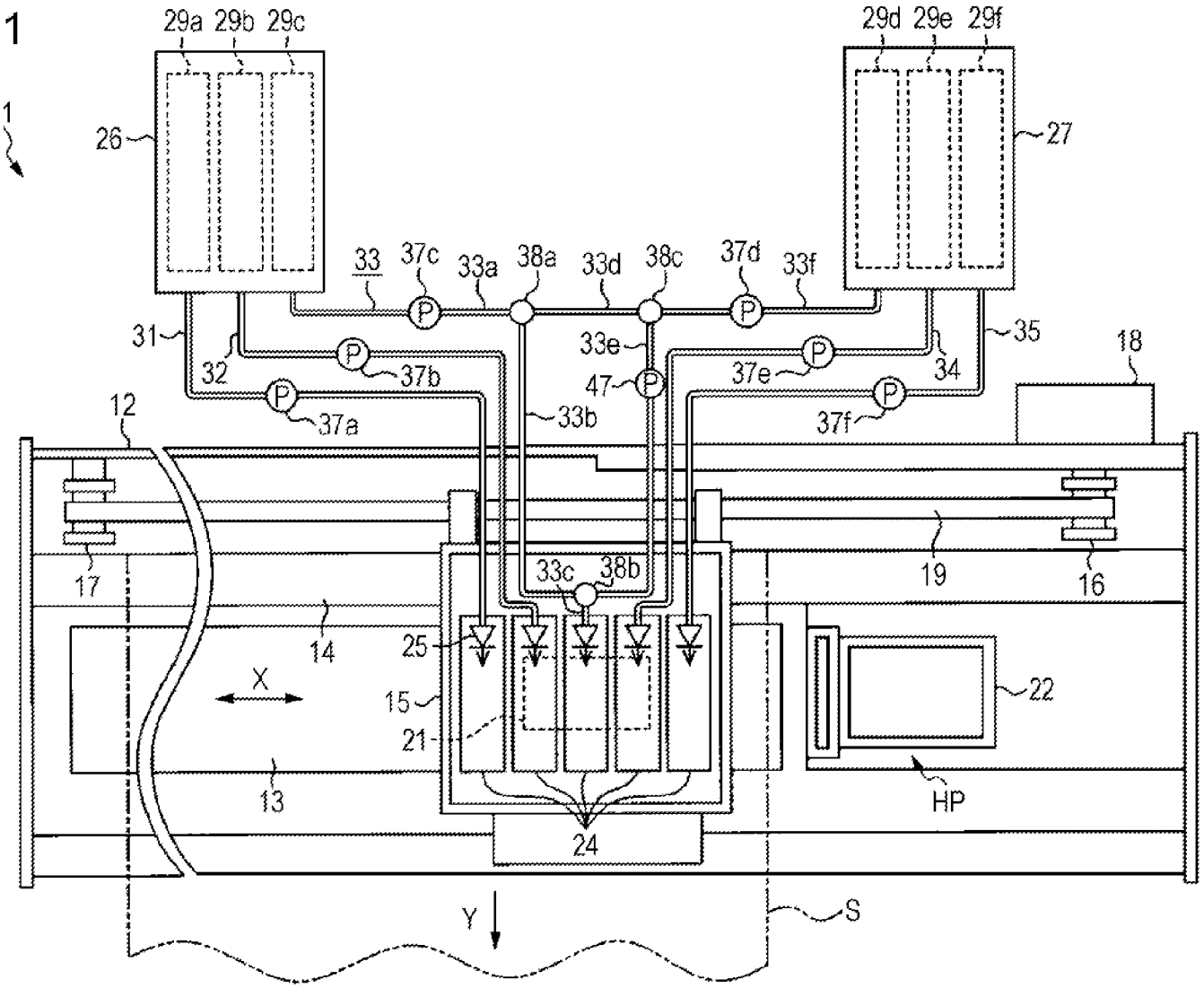
FIG. 1 is a schematic diagram of a printer of an embodiment.

As shown in FIG. 1, an ink jet printer (hereinafter, referred to as only a "printer") 11 as an example of the liquid ejecting apparatus has a main body 12 which has an approximately rectangular parallelepiped shape. A support member 13 is installed at a forward lower of the main body 12 along a longitudinal direction (a horizontal direction in FIG. 1) of the main body 12, which is a main scanning direction X. A recording sheet S is fed along a sub-scanning direction Y which is perpendicular to the main scanning direction X by a sheet feed mechanism (not shown) on the support member 13.

A bar shape guide shaft 14 is installed along the main scanning direction X on a backward top of the support member 13 in the main body 12. Further, on the guide shaft 14, a carriage 15 is supported. On a backward face of the main body 12, a drive pulley 16 and a driven pulley 17 are rotatably supported in a location corresponding to both end portions of the guide shaft 14. A carriage motor 18 is coupled to the drive pulley 16 and an endless shape timing belt 19 to which the carriage 15 is coupled is provided to extend between a pair of the pulleys 16 and 17. Then, the carriage 15 moves back and forth along the guide shaft 14 in the main scanning direction X by driving of the cartridge motor 18.

On a lower side of the carriage 15, a liquid ejecting head 21 in which a plurality of nozzles (not shown) for ejecting ink as an example of liquid are formed is attached. Further, in a move range of the carriage 15 in the main scanning direction X, a home position HP which is a stowed position of the liquid ejecting head 21 is mounted. Under the home position HP, a maintenance mechanism 22 for performing maintenance of the liquid ejecting head 21 is installed.

Further, on the carriage 15, at least one (5 in this embodiment) valve unit 24 for supplying ink at pressure appropriate for ejection to a nozzle which is formed on the liquid ejecting head 21 is provided. On the valve unit 24, a pressure adjustment valve 25 for opening valve when ink is ejected through the nozzle and pressure of ink on a lower stream, the side of the liquid ejecting head 21, is lowered is provided. That is, the pressure adjustment valve 25 functions as a so-called self-sealing valve for supplying ink from an upstream to a downstream by opening valve pursuant to consumption of ink on the liquid ejecting head 21.

On the printer 11, at least one (2 in this embodiment, 26 and 27) cartridge holder which forms a box shape is provided. Further, on each of the cartridge holders 26 and 27, at least one (3 in this embodiment, 29*a* to 29*c* and 29*d* to 29*f*) ink cartridge as an example of a container can be mounted.

Further, in this embodiment, yellow ink is stored in the first ink cartridge 29*a* and black ink is stored in the second ink cartridge 29*b*. Then, white ink is stored in the third ink cartridge 29*c* as an example of a first container and white ink is stored in the fourth ink cartridge 29*d* as an example of a second container. Furthermore, magenta ink is stored in the fifth ink cartridge 29*e* and cyan ink is stored in the sixth ink cartridge 29*f*.

Ink which is stored in the ink cartridges 29*a* to 29*f* is pigment ink which has a fear of pigment particles precipitating in ink solvent as time passes. Precipitation depends on the kinds of ink. In these kinds of ink, white ink is most easy to precipitate in comparison with the other kinds of ink.

Upstream end of at least one (5 in total in this embodiment, 31 to 35) ink supply tube is coupled to each of the cartridge holders 26 and 27. On the other hand, downstream ends of respective ink supply tubes 31 to 35 are coupled to different pressure adjustment valves 25. Further, on each of the ink supply tubes 31 to 35, feed pumps 37*a* to 37f for feeding ink which has been stored in the respective ink cartridges 29*a* to 29*f* to a downstream side are provided so as to correspond with the respective ink cartridges 29*a* to 29*f*.

That is, for example, ink which has been stored in the first ink cartridge 29*a* is supplied to the liquid ejecting head 21 via the first ink supply tube 31 and the valve unit 24 pursuant to driving of the first feed pump 37*a*. Further, ink which has been stored in the second ink cartridge 29*b* is supplied to the liquid ejecting head 21 via the second ink supply tube 32 and the valve unit 24 pursuant to driving of the second feed pump 37*b*.

Similarly, ink which has been stored in the fifth ink cartridge 29*e* is supplied to the liquid ejecting head 21 via the fourth ink supply tube 34 and the valve unit 24 pursuant to driving of the fifth feed pump 37e. Further, ink which has been stored in the sixth ink cartridge 29*f* is supplied to the liquid ejecting head 21 via the fifth ink supply tube 35 and the valve unit 24 pursuant to driving of the sixth feed pump 37*f*.

Next, the third ink supply tube 33 for supplying ink which has been stored in the third ink cartridge 29*c* and the fourth ink cartridge 29*d* to a side of the liquid ejecting head 21 will be explained. Note that the third ink supply tube 33 is configured by a plurality of tubes 33*a* to 33*f* being coupled each other via joints 38*a* to 38*c* such as three way tubes.

In the first tube 33*a*, the upstream end is coupled to the first cartridge holder 26 so as to correspond with the third ink cartridge 29*c* and the downstream end is coupled to the first joint 38*a*. In the second tube 33*b*, the upstream end is coupled to the first joint 38*a* and the downstream end is coupled to the second joint 38*b*.

In the third tube 33*c*, the upstream end is coupled to the second joint 38*b* and the downstream end is coupled to the pressure adjustment valve 25. In the fourth tube 33*b*, one end (left end in FIG. 1) is coupled to the first joint 38*a* and the other end (right end in FIG. 1) is coupled to the third joint 38*c*.

In the fifth tube 33*e*, the upstream end is coupled to the third joint 38*c* and the downstream end is coupled to the second joint 38*b*. In the sixth tube 33*f*, the upstream end is coupled to the second cartridge holder 27 so as to correspond with the fourth ink cartridge 29*d* and the downstream end is coupled to the third joint 38*c*.

Further, in the first tube 33*a*, the third feed pump 37*c* as an example of a first supply pump which is driven when ink that has been stored in the third ink cartridge 29*c* is supplied to a downstream side is provided. Similarly, in the sixth tube 33*f*, the fourth feed pump 37*d* as an example of a second supply pump which is driven when ink that has been stored in the fourth ink cartridge 29*d* is supplied to a downstream side is provided. Furthermore, in the fifth tube 33*e*, a circulation pump 47 for circulating ink in the second tube 33*b*, the fourth tube 33*d*, and the fifth tube 33*e* is provided.

Figure 2:
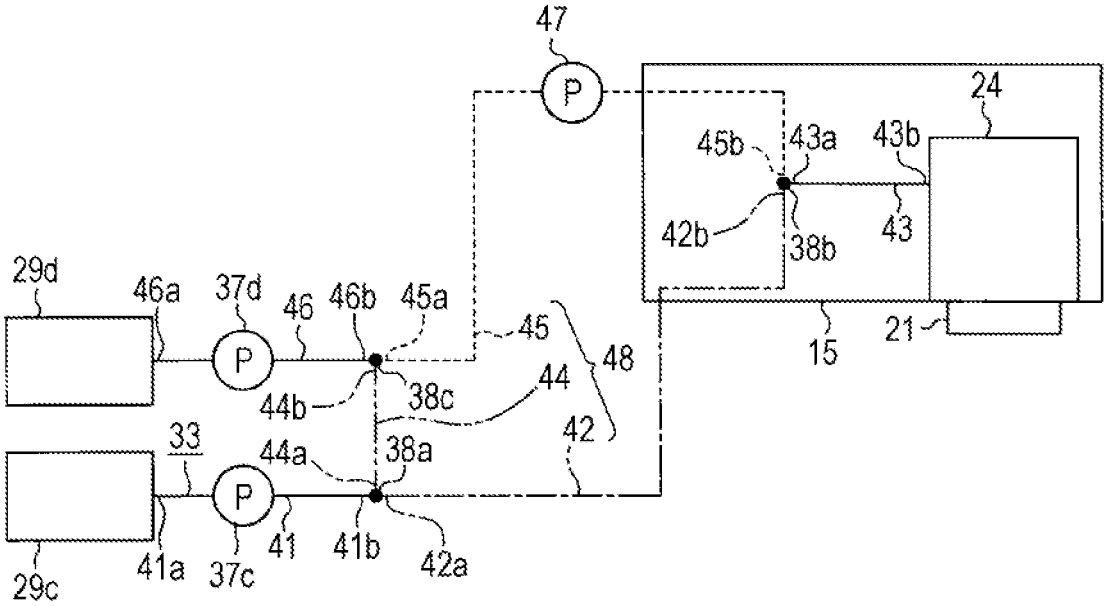
FIG. 2 is a schematic diagram of a flow path constituted by a third ink supply tube.

FIG. 2 shows flow paths 41 to 46 which the first tube 33*a* to the sixth tube 33*f* in the third ink supply tube 33 constitute by varying types of lines among adjacent flow paths. That is, the first tube 33*a* constitutes the first flow path 41 shown by a solid line, the second tube 33*b* constitutes the second flow path 42 shown by a dashed line, the third tube 33*c* constitutes the third flow path 43 shown by a solid line. Further, the fourth tube 33*d* constitutes the fourth flow path 44 shown by a chain double-dashed line, the fifth tube 33*e* constitutes the fifth flow path 45 shown by a broken line, and the sixth tube 33*f* constitutes the sixth flow path 46 shown by a solid line.

As shown in FIG. 2, an upstream end 41*a* of the first flow path 41 is coupled to the third ink cartridge 29*c* via an ink supply portion (not shown). Further, the first joint 38*a* is coupled to a downstream end 41*b* of the first flow path 41, an upstream end 42*a* of the second flow path 42 and one end of the fourth flow path 44 (lower end in FIG. 2). That is, the first flow path 41, the second flow path 42 and the fourth flow path 44 are coupled via the first joint 38*a* and communicated with each other.

The second joint 38*b* is coupled to a downstream end 42*b* of the second flow path 42, an upstream end 43*a* of the third flow path 43, and a downstream end 45*b* of the fifth flow path 45. That is, the second flow path 42, the third flow path 43 and the fifth flow path 45 are coupled via the second joint 38*b* and communicated with each other. Further, a downstream end 43*b* of the third flow path 43 is coupled to the valve unit 24.

To the third joint 38*c*, the other end (top end of FIG. 2) 44*b* of the fourth flow path 44, an upstream end 45*a* of the fifth flow path 45, and a downstream end 46*b* of the sixth flow path 46 are coupled. That is, the fourth flow path 44 and the fifth flow path 45 and the sixth flow path 46 are coupled via the third joint 38*c* and communicated with each other. Further, an upstream end 46*a* of the sixth flow path 46 is coupled to the fourth ink cartridge 29*d* via an ink supply portion (not shown).

In this embodiment, the first flow path 41, the second flow path 42 and the third flow path 43 constitute an example of the first flow path for supplying ink from the upstream side that is a side of the third ink cartridge 29*c* in which ink is stored to the downstream side that is a side of the liquid ejecting head 21. Then, the first joint 38*a* functions as an example of the joint on the upstream side on the first flow path and the second joint 38*b* that is on the downstream side than the first joint 38*a* functions as an example of the joint on the downstream side.

The fourth flow path 44 and the fifth flow path 45 constitute an example of the second flow path. Note that one end 44*a* of the fourth flow path 44 corresponds to an example of an upstream end of the second flow path and the downstream end 45*b* of the fifth flow path 45 corresponds to an example of a downstream end of the second flow path. Then, the fourth flow path 44 and the fifth flow path 45 constitute a circulation flow path 48 in which ink can be circulated together with the second flow path 42 that is a flow path section between the first joint 38*a* and the second joint 38*b*. Further, the sixth flow path 46 constitutes an example of a third flow path for supplying ink from an upstream side that is a side of the fourth ink cartridge 29*d* in which ink is stored to a downstream side that is a side of the circulation flow path 48.

Further, the first flow path 41 and the sixth flow path 46 are provided to be associated with ink cartridge 29*c* and 29*d* respectively. The first flow path 41 functions as an example of the flow path on a side of the container in which ink is supplied from an upstream side that is a side of the third ink cartridge 29*c* to a downstream side that is an opposite side of the third ink cartridge 29*c*. Further, the sixth flow path 46 also functions as an example of the flow path on a side of the container for supplying ink from an upstream side that is a side of the fourth ink cartridge 29*d* to a downstream side that is an opposite side of the fourth ink cartridge 29*d*.

The circulation flow path 48 is provided on a downstream side than the first flow path 41 and the sixth flow path 46. In addition, the circulation flow path 48 is coupled to the downstream end 41*b* of the first flow path 41 and the downstream end 46*b* of the sixth flow path 46. It is possible to circulate ink which has been supplied from each ink cartridge 29*c* and 29*d*.

Further, the third flow path 43 functions as an example of a head-side flow path for supplying ink to a downstream side that is a side of the ink ejecting head 21, and the upstream end 43*a* is coupled to the circulation flow path 48.

Meanwhile, the cartridge holders 26 and 27 are provided on a side of a gravity direction (lower position) than the carriage 15. Therefore, the third ink supply tube 33 which couples the cartridge holders 26 and 27 and the valve unit 24 that is mounted on the carriage 15 has difference in height in the gravity direction. Therefore, the flow paths 41 to 46 which the third ink supply tube 33 constitutes have differences in height.

Further, the second joint 38*b* is mounted on the carriage 15 and provided on the upper side in comparison with the first joint 38*a* and the third joint 38*c*. Therefore, in the second flow path 42 and the fifth flow path 45, the downstream ends 42*b* and 45*d* are provided on the upper side in comparison with the upstream ends 42*a* and 45*a*. The circulation flow path 48 has difference in height in the gravity direction. On the other hand, difference in height that the first flow path 41, the third flow path 43 and the sixth flow path 46 have is smaller in comparison with difference in height of the circulation flow path 48 and these paths 41, 43 and 46 are provided in approximately horizontal with each other.

Further, a part of the second flow path 42 and a part of the fifth flow path 45, and the third flow path 43 and the second joint 38*b* move back and forth in the main scanning direction X pursuant to movement of the carriage 15. Therefore, the carriage 15 functions as an example of movement mechanism for moving at least a part of the circulation flow path 48 and the liquid ejecting head 21.

Next, an action at the time of supplying ink from the ink cartridges 29*a* to 29*f* to the liquid ejecting head 21 will be explained with focusing on the action at the time of supplying ink especially from the third ink cartridge 29*c* and the fourth ink cartridge 29*d*. Here, it is assumed that the first flow path 41 to the sixth flow path 46 are filled with ink as an initial state.

Firstly, in the third feed pump 37*c* and the fourth feed pump 37*d*, a pump corresponding to the ink cartridge for supplying ink is driven. That is, for instance, when ink which has been stored in the third ink cartridge 29*c* is supplied, the third feed pump 37*c* is driven.

When the third feed pump 37*c* is driven, ink in the first flow path 41 is pressurized to a downstream and pressure acts on the other second flow path 42 to the sixth flow path 46. Further, when the third feed pump 37*c* is driven, the fourth feed pump 37*d* and the circulation pump 47 are stopped. Therefore, in ink, pressure is accumulated between the first joint 38*a* and the fourth feed pump 37*d*, between the third joint 38*c* and the circulation pump 47, and between the second joint 38*b* and the circulation pump 47 and supplied to the second flow path 42 and the third flow path 43. Therefore, when ink is consumed in the liquid ejecting head 21 to open the pressure adjustment valve 25, ink which is stored in the third ink cartridge 29*c* is supplied to the liquid ejecting head 21 via the first flow path 41, the second flow path 42 and the third flow path 43.

On the other hand, when the fourth feed pump 37*d* is driven, ink in the sixth flow path 46 is pressurized to a downstream side and the applied pressure acts on the first flow path 41 to the fifth flow path 45. Further, when the fourth feed pump 37*d* is driven, the third feed pump 37*c* and the circulation pump 47 are stopped. Therefore, in ink, pressure is accumulated between the first joint 38*a* and the third feed pump 37*c*, between the third joint 38*c* and the circulation pump 47, and between the second joint 38*b* and the circulation pump 47 and then ink is supplied to the fourth flow path 44, the second flow path 42, and the third flow path 43. Therefore, when ink is consumed in the liquid ejecting head 21 to open the pressure adjustment valve 25, ink which has been stored in the fourth ink cartridge 29*d* is supplied to the liquid ejecting head 21 via the sixth flow path 46, the fourth flow path 44, the second flow path 42 and the third flow path 43.

Then, supplied ink is pressurized to be adjusted at the valve unit 24 and ejected to the recording sheet S which is supported by the support member 13 through a nozzle of the liquid ejecting head 21, thereby performing print process for forming images, and so on. That is, the liquid ejecting head 21 ejects ink which is supplied from two or more ink cartridges (the third ink cartridge 29*c* and the fourth ink cartridge 29*d*) for storing ink.

Further, at the time of non-printing when ejection is not performed through a nozzle of the liquid ejecting head 21 to the recording sheet S, the carriage 15 is located at the home position HP and the circulation pump 47 is driven so as to pressurize ink in the fifth flow path 45 from the downstream to the upstream. Note that, at the time of non-printing, driving of each of the third feed pump 37*c* and the fourth feed pump 37*d* is stopped. Therefore, pressure of ink is maintained between the first joint 38*a* and the third feed pump 37*c*, and between the third joint 38*c* and the fourth feed pump 37*d*. Further, at the time of no-printing, since ink consumption in the liquid ejecting head 21 is suppressed, the pressure adjustment valve 25 maintains closing valve state and pressure of ink is maintained between the second joint 38*b* and the pressure adjustment valve 25.

Therefore, ink which has been pressurized by the circulation pump 47 flows to the fourth flow path 44 via the third joint 38*c* and flows to the second flow path 42 via the first joint 38*a* and then, flows to the fifth flow path 45 via the second joint 38*b*. Therefore, when the circulation pump 47 is driven, ink is circulated in the circulation flow path 48.

According to the above embodiments, following effects can be obtained.

1. It is possible to supply ink which is supplied from the third ink cartridge 29*c* to the fourth ink cartridge 29*d* to the liquid ejecting head 21 via one circulation flow path 48. Therefore, it is possible to increase the number of ink cartridges for supplying liquid to the liquid ejection head 21 via the circulation flow path 48 while suppressing complication of the structure.

2. It is possible to select an ink cartridge in which ink is supplied to the liquid ejecting head 21 by providing the third feed pump 37*c* so as to correspond with the third ink cartridge 29*c* and providing the fourth feed pump 37*d* so as to correspond with the fourth ink cartridge 29*d*.

3. When the carriage 15 moves the liquid ejecting head 21, at least a part of the circulation flow path 48 follows to move. Therefore, ink is stirred not only pursuant to circulation in the circulation flow path 48 but also pursuant to movement by the carriage 15. Therefore, it is possible to effectively stir ink while suppressing increase of the number of members.

4. For instance, when position of the liquid ejecting head 21 and positions of the ink cartridges 29*c* and 29*d* are different in a gravity direction, there causes difference in height in the flow paths 41 to 46 for supplying ink to the liquid ejecting head 21 from the ink cartridges 29*c* and 29*d*. Further, when ink whose ingredients are easy to precipitate is supplied, inclinations of the flow paths 41 to 46 are larger in portions with large difference in height than those with small difference in height. Therefore, a degree of precipitation becomes larger. With respect to this point, it is possible to reduce difference in height in portions other than the circulation flow path 48 by providing difference in height with the circulation flow path 48. That is, it is possible to supply ink to the liquid ejecting head 21 while suppressing precipitation of ink ingredients by providing difference in height with the circulation flow path 48 in which stirring is possible by circulating ink.

Further, it is possible to vary the above embodiment as follows.

Figure 3:
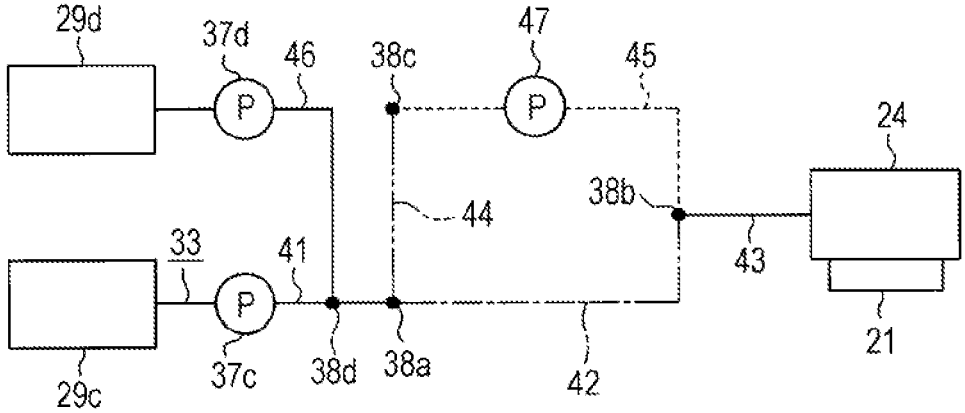
FIG. 3 is a schematic diagram of a flow path of a variation.

In the above embodiments, as shown in FIG. 3, the sixth flow path 46 may be coupled to the first flow path 41 via the fourth joint 38*d* (a variation example). Further, in this case, the third feed pump 37*c* is provided on an upper stream side than the fourth joint 38*d* provided on the most upstream side among the first joint 38*a*, the second joint 38*b*, and the fourth joint 38*d* to which other flow paths are coupled in the first flow path 41 to the third flow path 43.

In the above embodiments, the downstream end 46*b* of the sixth flow path 46 may be coupled to any one of the flow paths, the first flow path 41 and the second flow path 42 which is a section on an upper stream side than the second joint 38*b* among the first flow path 41 to the third flow path 43, the fourth flow path 44 and the fifth flow path 45. Further, the downstream end 46*b* of the sixth flow path 46 may be coupled to the first joint 38*a*.

In the above embodiments, the first flow path 41, the third flow path 43, and the sixth flow path 46, other than the circulation flow path 48 can have difference in height in a gravity direction. Further, the cartridge holders 26 and 27 and the carriage 15 are arranged with same height in a gravity direction not to have difference in height in the first flow path 41 to the sixth flow path 46.

In the above embodiments, the circulation flow path 48 may not be mounted on the carriage 15. That is, at least a part of the circulation flow path 48 may be moved pursuant to movement of the carriage 15 by taking around the flow path 48. All of the circulation flow path 48 may be mounted on the carriage 15 or taken around to be moved pursuant to movement of the liquid ejecting head 21. Further, only the third flow path 43 may be moved pursuant to movement of the liquid ejecting head 21 without mounting the circulation flow path 48 on the carriage 15 and taking around the flow path 48.

In the above embodiments, either one of the third feed pump 37*c* and the fourth feed pump 37*d* may be provided. Further, the third feed pump 37*c* and the fourth feed pump 37*d* may not be provided. That is, ink may be supplied from the ink cartridges 29*c* and 29*d* pursuant to reduced pressure on the downstream side that is caused pursuant to consumption of ink in the liquid ejecting head 21. Note that, in this case, it is preferable that a valve be provided so as to avoid stream from downstream to upstream in the first flow path 41 and the sixth flow path 46. Further, pressure may be applied in the ink cartridges 29*c* and 29*d* to serve as a pump for supplying ink to downstream.

In the above embodiments, the first flow path 41 to the sixth flow path 46 may be configured of a member having stiffness regardless of the third ink supply tube 33 having flexibility. That is, the flow paths 41 to 46 may be formed by bonding a film on a member to which a concave is formed, for instance, so as to cover the concave. Further, the flow paths 41 to 46 may be configured of both of a member having flexibility and a member having stiffness. Further, the first tube 33*a* to the sixth tube 33*f* may each be bonded with adhesive. That is, the joints 38*a* to 38*c* need not be separate members and may show portions in which the flow paths 41 to 46 cross.

In the above embodiments, the first flow path 41 may be coupled to either one of the circulation flow path 48 and the sixth flow path 46. That is, the downstream end 41*b* of the first flow path 41 may be coupled to any one of the second flow path 42, the fourth flow path 44, the fifth flow path 45 and the sixth flow path 46. Here, when the downstream end 41*b* of the first flow path 41 is coupled to the sixth flow path 46, the downstream end 46*b* of the sixth flow path 46 must be coupled to the circulation flow path 48. Further, the downstream end 41*b* of the first flow path 41 may be coupled to the third joint 38*c*.

Further, even if the first flow path 41 is coupled to either one of the circulation flow path 48 and the sixth flow path 46, a flow path which couples the third ink cartridge 29*c* and the liquid ejecting head 21 functions as an example of the first flow path. That is, when the first flow path 41 is coupled to the second flow path 42, a section from a portion where the first flow path 41 is coupled in the first flow path 41 and the second flow path 42 to the second joint 38*b*, and the third flow path 43 function as an example of the first flow path. Further, a section from the first joint 38*a* to a portion where the first flow path 41 is coupled in the second flow path 42, the fourth flow path 44 and the fifth flow path 45 function as an example of the second liquid supply flow path. Then, a portion where the first flow path 41 is coupled in the second flow path 42 functions as an example of an upstream side joint.

In the above embodiments, an ink cartridge which is connectable to the circulation flow path 48 may be three or more. Further, an ink cartridge that is newly mounted may be coupled to any of the flow paths that are on the upstream side than the second joint 38*b*. That is, a flow path which corresponds to the ink cartridge may be coupled to any of the first flow path 41, the second flow path 42, and the fourth flow path 44 to the sixth flow path 46. Further, when two or more ink cartridges are mounted newly, two or more flow paths which are newly mounted function as an example of a flow path on the container-side. When they are coupled to the circulation flow path 48 via another flow path, flow paths which are newly mounted may be coupled.

In the above embodiments, the ink supply tubes 31, 32, 34 and 35 other than the third ink supply tube 33 may have the circulation flow path 48 and two or more ink cartridges in which the same ink is stored may be connectable.

In the above embodiments, the circulation pump 47 may be mounted at an arbitrary location in the circulation flow path 48. That is, the circulation pump 47 may be mounted on the second flow path 42 or the fourth flow path 44. Further, an orientation for the circulation pump 47 circulating ink may be inverted. That is, ink is supplied from the fifth flow path 45 to the second flow path 42 and ink may be circulated in a direction for supplying ink from the second flow path 42 to the fourth flow path 44.

In the above embodiments, the third feed pump 37*c* and the fourth feed pump 37*d* may be driven at the same time. When the ink cartridge is exchanged, the corresponding feed pump may be stopped. For instance, when the third ink cartridge 29*c* is exchanged, driving of the third feed pump 37*c* may be stopped and the fourth feed pump 37*d* may be driven. By driving the fourth feed pump 37*d*, it is possible to continue printing with ink which is supplied from the fourth ink cartridge 29*d* even when the third ink cartridge 29*c* is exchanged.

In the above embodiments, the liquid ejecting apparatus may be the one for ejecting or discharging liquid other than ink. Further, the state of the liquid which is ejected as minute drops from the liquid ejecting apparatus includes granule forms, tear-drop forms, and forms that pull tails in a string-like form therebehind. Further, "liquid" here may be material which can be ejected from the liquid ejecting apparatus. For instance, the material may be liquid phase. It may include liquid with high or low viscosity, fluid like sol, gel water, other inorganic solvents, organic solvents, solutions, liquid resins, liquid metals (metallic melts). Further, it may include not only liquid as a single state of a matter but also solvents in which a functional material composed of solid body like pigments and metal particles are solved, scattered or mixed. Representative examples of the liquid include ink and liquid crystals and so forth which are explained in the above embodiments. Here, "ink" includes various liquid compositions such as general water-based inks and oil-based inks, gel inks, and hot-melt inks. A concrete example of the liquid ejecting apparatus includes a liquid ejecting apparatus for ejecting liquid which contains material like electrode materials or color materials used for manufacture of a liquid crystal display, an EL (Electro Luminescent) display, a surface emitting display, a color filter and so forth in the scattered or solvent forms. Further, it may be a liquid ejecting apparatus for ejecting bioorganic matters used for bio chip manufacture, a liquid ejecting apparatus for ejecting liquid which is a sample used as a precision pipette, a print apparatus or a micro dispenser, and so forth. Further, it may be a liquid ejecting apparatus for ejecting lubricant on precision machines like a clock or a camera at a pinpoint timing, or a liquid ejecting apparatus for ejecting a transparent resin like an ultraviolet curing resin on a substrate so as to form a minute hemispheric lens (optical lens) used for an optical communication device etc. Further, it may be a liquid ejecting apparatus for ejecting acid or alkali etching solution so as to etch a substrate.

Cross References to Related Applications

The entire disclosure of Japanese Patent Application No. 2013-022936, filed Feb. 8, 2013 is expressly incorporated by reference herein.

What is claimed is:

1. A liquid ejecting apparatus comprising:

a liquid ejecting head for ejecting liquid;

a first flow path through which liquid is supplied from a first container provided at an upstream to the liquid ejecting head provided at a downstream;

a second flow path that forms a circulation flow path by coupling an upstream end thereof to an upstream joint of the first flow path and by coupling a downstream end thereof to a downstream joint of the first flow path, the liquid being capable of circulating through the circulation flow path including the second flow path and a section between the upstream joint and the downstream joint in the first flow path; and a third flow path through which liquid is supplied from a second container provided at an upstream to the liquid ejecting head and an upstream to the circulation flow path provided at a downstream, wherein a downstream end of the third flow path is coupled to one of the second flow path and a section of an upstream side of the downstream joint in the first flow path.

2. The liquid ejecting apparatus according to claim 1, further comprising:

a first supply pump that is provided on the first flow path at a section between the first container and a joint provided on a most upstream side among joints that are coupled to other flow paths and that supplies liquid stored in the first container to a downstream; and a second supply pump that is provided on the third flow path and supplies liquid stored in the second container to a downstream.

3. The liquid ejecting apparatus according to claim 1, wherein the circulation flow path is provided to have difference in height in a gravity direction.

4. The liquid ejecting apparatus according to claim 1, wherein the liquid that is circulated in the circulation flow path circulates without being supplied to the first or second containers.

5. The liquid ejecting apparatus according to claim 1, wherein the liquid ejecting head forms a terminal end of liquid flow from the first container, the second container, the first flow path, the second flow path, and the third flow path.

6. A liquid ejecting apparatus comprising:

a liquid ejecting head which ejects liquid that is supplied from two or more containers storing liquid;

two or more container-side flow paths which are provided for the respective containers and through which liquid is supplied from the containers provided at an upstream to the liquid ejecting head that is an opposite side of the container;

a circulation flow path which is provided on a downstream of the container-side flow paths and which is capable of circulating liquid supplied from the containers; and a head-side flow path in which an upstream end thereof is coupled to the circulation flow path and through which liquid is supplied to the liquid ejecting head provided at a downstream, wherein, in each of the container-side flow paths, a downstream end thereof is coupled to anyone of the circulation flow path and the other container-side flow paths and at least one downstream end of the container-side flow paths is coupled to the circulation flow path.

7. The liquid ejecting apparatus according to claim 6, wherein the liquid that is circulated in the circulation flow path circulates without being supplied to the first or second containers.

* * * * *